United States Patent [19]

Lee

[11] Patent Number: 4,815,515

[45] Date of Patent: Mar. 28, 1989

[54] STRUCTURE OF WINDOW SHADE

[76] Inventor: Song L. Lee, No. 222-2 Change Yuan Rd., Hua Tarn Shiang, Chang Hwa, Taiwan

[21] Appl. No.: 46,685

[22] Filed: May 7, 1987

[51] Int. Cl.[4] ..... A47H 1/00

[52] U.S. Cl. ..... 160/23.1; 160/310

[58] Field of Search ..... 160/23 R, 241, 237, 160/310, 311

[56] References Cited

U.S. PATENT DOCUMENTS

| | | | |
|---|---|---|---|
| 1,367,031 | 2/1921 | Fedders | 160/237 X |
| 1,743,345 | 1/1930 | Heilweil et al. | 160/237 |
| 1,830,364 | 11/1931 | Knudson | 160/241 X |
| 2,055,511 | 9/1936 | Twiss | 160/311 X |
| 2,404,257 | 7/1946 | Thomas | 160/241 X |
| 3,186,473 | 6/1965 | Myers et al. | 160/310 R |
| 3,583,465 | 6/1971 | Youngs | 160/310 X |
| 3,747,132 | 7/1973 | Foster | 160/310 X |

FOREIGN PATENT DOCUMENTS

| | | | |
|---|---|---|---|
| 16154 | 9/1891 | United Kingdom | 160/237 |

*Primary Examiner*—Robert W. Gibson, Jr.

*Attorney, Agent, or Firm*—Birch, Stewart, Kolasch & Birch

[57] ABSTRACT

An improved window shade structure which comprises two sets of brackets mounted on a window frame; two rollers, to be fixed on the brackets; a shade to the be fixed to rollers and having length larger than the distance between the two rollers; a driving mechanism with a motor therein to drive the shade to move and wind the shade between the two rollers; and the window shade having a plurality of holes in various sizes along its length and being adjusted to a desirable position so as to obtain a suitable intensity of light by the function of the driving mechanism.

6 Claims, 4 Drawing Sheets

STRUCTURE OF WINDOW SHADE

BACKGROUND OF THE INVENTION

The present invention relates in general to a new and useful window shade structure, and more particularly to an improved structure wherein the window shade can control the amount of penetrating sunlight.

Advances of scientific technology have upgraded the living standard. People thus take as essential that they have devices which are convenient, safe and comfortable. Conventional drapery or shades of the louvers type are used in houses. There are several drawbacks in these arrangements though they do work in keeping out light. These drawbacks are: (1) Making noise or flying around due to the wind blowing. (2) The light being too bright and strong when they are fully opened but too dark when the opening is fully covered; and moreover, when opened partially, the light does not penetrate evenly. (3) Cords must be used for operation, and it's easy to pick a wrong one since it's difficult to distinguish each cord's function. (4) The high cost makes it impossible for them to be recognized popularly.

Automotive vehicle windows are usually covered with adhesive film to soften the sunlight, or simply with drapery. Though both of them arrangements are effective, shortcomings are present as follows: (1) Under sunlight, they do keep out the sunlight, But, when the car is backed up at night (esp. in the rain), safety is decreased since the adhesive film hinders your sight the vision of the operator. (2) Once the film is applied, it is difficult to remove and adjust the intensity of light inside the car. (3) The drapery, which is not attractive, is also not practical since it must be operated by hand. Moreover, it is difficult and dangerous especially when the vehicle is being driven and the operator must concentrate on his driving. (4) The light will be too strong when the drapery is fully opened while it will be too dark when fully closed. That is, it is necessary to operate it at least twice a day(day and night) or even more, depending on the changeable weather conditions and your sensitivity to the light.

DETAILED DESCRIPTION OF THE INVENTION

It is, therefore, a primary object of the present invention to provide an improved window shade structure which is operationally controllable with regard to the mount of light admitted by means of a simple design and wherein a motor rotates as directed to adjust the position of the window shade.

It is another object of the present invention to provide an improved window shade in which holes are made and designed such that it is possible to adjust the amount of penetrating light with great comfort and convenience.

It is a further object of the present invention to provide an improved window shade structure which is automatically controllable with regard to light so as to ensure your safety when you are driving either during the day or at night.

According to the present invention, the improved structure of window shade includes:

2 sets of brackets mounted on the window frame; 2 rollers, to be installed on the brackets; a window shade with one end fixed to one of the rollers respectively and having a length longer than the distance between the two rollers and; a driving mechanism for driving the shade to move and roll between the two rollers by means of a motor.

The window shade is provided with a plurality of holes of various sizes along its length and is adjusted to a desirable position so as to obtain a suitable intensity of light by the control of the driving mechanism.

In another feature of the present invention, there is provided an improved window shade structure in which a casing is provided to beautifully cover the shade wound on the roller.

In another feature of the present invention, a bearing is provided between the rollers and brackets to smooth the rotation of the rollers.

In another aspect of the present invention, there is provided an improved window shade structure in which the driving mechanism consists of: a pair of wheels with one wheel being mounted on each roller; a belt; a motor to be installed beside the window; and a shaft connecting the motor with one of the rollers to enable these two parts to be connected.

In another aspect of the present invention, there is provided an improved window shade structure in which the driving mechanism comprises a torsion spring located on one of the rollers and a motor. When the motor rotates clockwise, the shade will move toward the roller without the spring. When the motor rotates counterclockwise, the shade goes back to the other roller by means of the released force from the torsion spring. Thus, the shade can be adjusted to select the holes having the desired sizes.

In another aspect of the present invention, the improved window shade structure is constructed with more than one set of driving wheels and more than one belt in order to make the driving more smooth.

In another aspect of the present invention, the window shade can be divided into several sections along the length, with the holes designed thereon being increasing or decreasing in diameter.

In another aspect of the present invention, the window shade is made of transparent plastic cloth in color shading from light to dark.

BRIEF DESCRIPTION OF THE DRAWINGS

The present invention possesses many advantages and purposes which may be made more clearly apparent from the consideration of forms in which it may be embodied. Reference now will be made to the accompanying drawings in which.

DETAILED DESCRIPTION OF PREFERRED EMBODIMENTS

Figure 1:
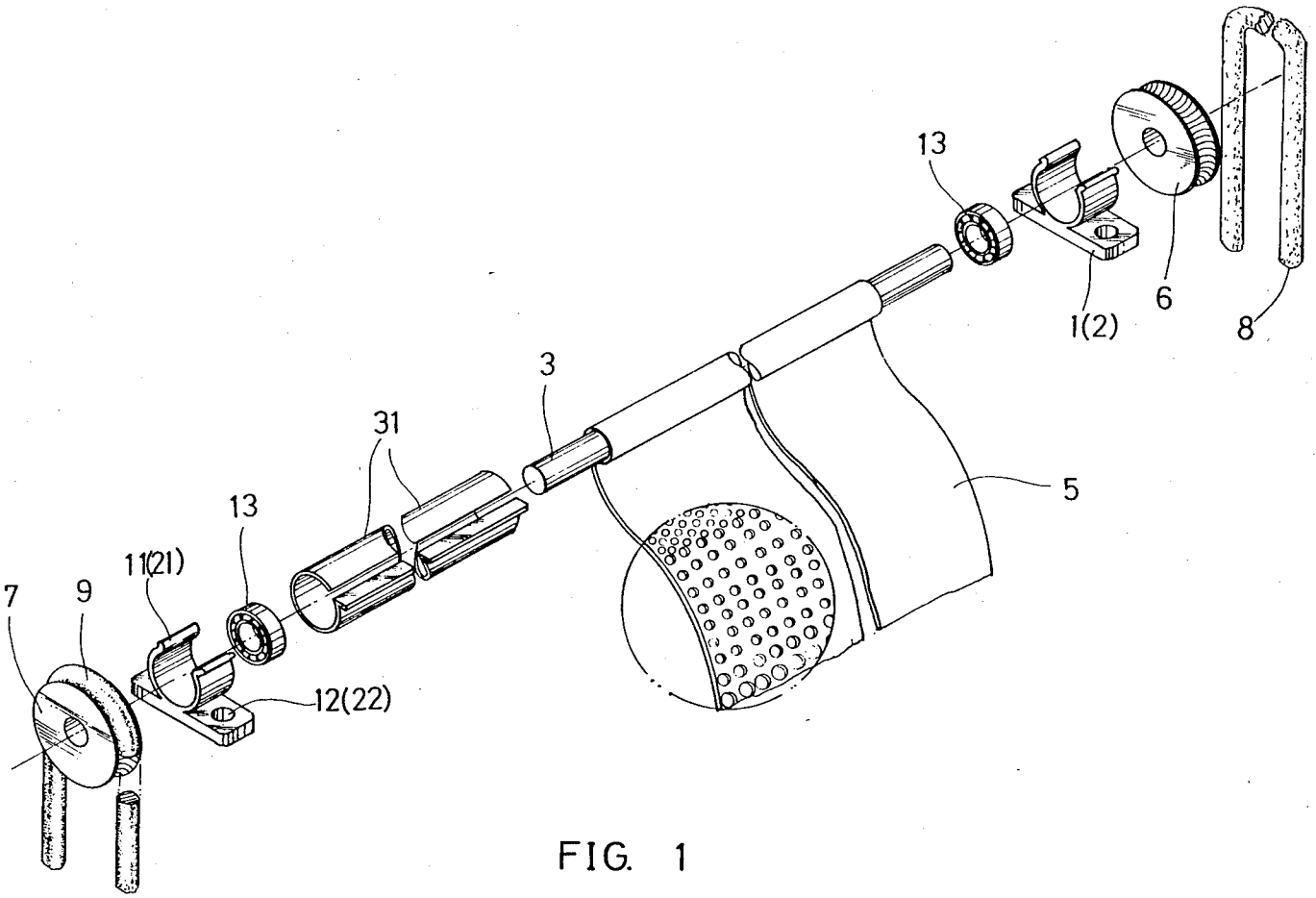
FIG. 1 is a partial exploded perspective view of an improved structure of window shade in accordance with the present invention.
Figure 2:
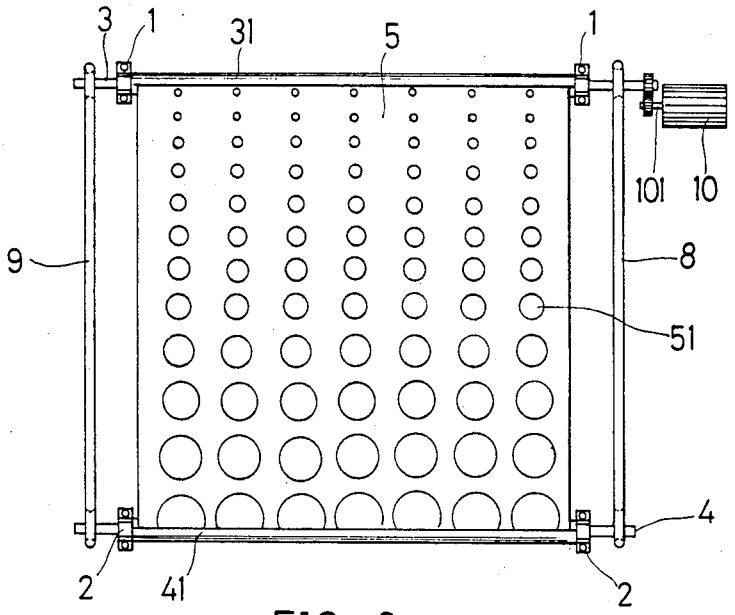
FIG. 2 is a plan view of the improved structure of window shade in accordance with the present invention.

Referring now, specifically to FIGS. 1 and 2, FIG. 1 illustrates an embodiment of the improved structure of window shade which comprises two sets of brackets 1, 2; two rollers 3, 4; a window shade 5; two pairs of driving wheels 6, 7; two belts 8, 9; and one motor 10, in which:

The brackets 1. 2 are to be mounted beside the window or on the window frame, in which, one set of brackets 1 is located on the top while the other set 2 is located on the bottom. Holders 11, 21 are integrally formed on brackets 1, 2.

There are holes 12, 22 in the brackets 1, 2 for mounting beside or on the window frame. Holders 11, 21 which are formed integrally with brackets 1, 2 are made of such flexible material that they open when a force is imposed and recover after said force is removed.

Of the two rollers 3, 4, one is located on the top and the other on the bottom and, they are fitted respectively into the holders 11, 21 wich are integral with brackets 1, 2.

Of course, in order to make the rollers 3, 4 rotate more smoothly, a bearing 13 may be provided between the bracket and the roller. In other words this regard, bearing 13 must fit into the holders 11, 21 perfectly.

One end of the window shade 5, which is made of nonwoven material, is fixed on roller 3 while the other end is fixed on roller 4 with its length being larger than the distance between rollers 3 and 4 to allow part of the shade to remain on the rollers. Along the length of window shade, a plurality of holes 51 are made and designed with the size increasing or decreasing gradually. In order to cover the shade wound on rollers 3, 4, casings 31, 41 may be added to each set of brackets. The rollers 3, 4 with the shade 5 and the bearings 13 are placed in casings 31, 41. Then the casings 31, 41 are placed into the holders 11, 21 which are integral parts of brackets 1, 2. The flexibility of the holders 11, 21 helps to fix the assembly of casings 31, 41 and bearings 13 in position.

The two pairs of driving wheels 6, 7 are mounted on rollers 3, 4 respectively, so that driving wheels 6, 7 and rollers 3, 4 can rotate at the same time.

The two belts 8, 9 make rollers 3, 4 rotate synchronously.

Mounted next to the window on the same axis as rollers 3, 4 is motor 10 which is the main source of power. It connects with one of the rollers 3 by means of the shaft 101.

Indicated above is a brief description of the respective location and the assembled relationship of each part of the invention. For better understanding, the theory of operation of the invention will be further described in detail as follows:

Referring now to FIG. 2, when motor 10 is turned on roller 3 rotates accordingly due to its connection with motor 10 by means of shaft 101. Rotation of roller drives wheels 6, 7 on the top and wheels 6, 7, and roller 4 on the bottom at the same time by means of belts 8, 9.

This assembly is constructed such that in whichever direction the motor 10 runs, the user can operate window shade 5 easily and quickly and keep it at the desired position according to the expected1 intensity of light, inside a car or a house. Light penetrates in through the holes 51 on shade 5 whose various dimensions and adjustable movement make it possible for people to enjoy the amount of light they feel most comfortable in.

Futhermore, in accordance with the present invention, if the window is to be closed, opened or cleaned, all that is necessary is to control the motor to allow all of the shade to be wound on the roller on the top, that is, to move all the shade 5 from roller 4 to roller 3. This is accomplished by taking casing member 41 which comprises bearing 13 and roller 4 out of holder 21 which is integrated with bracket 2. Then, turn on the motor, whereupon the casing member 41 which comprises bearing 13 and roller 4 will be lifted to the top as a result of motor's functioning on roller 3 which drives shade 5.

Figure 3:
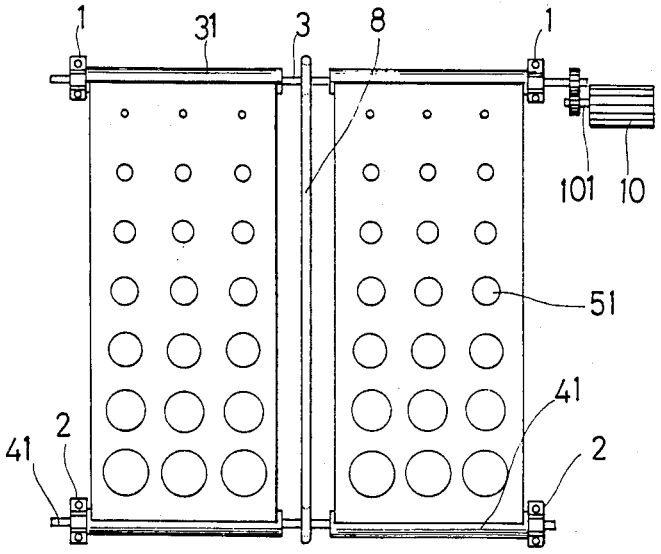
FIG. 3 is a plan view of the improved structure of window shade in accordance with another embodiment of the present invention.

Now referring to FIG. 3, this figure is a plan view of the improved structure of a window shade in accordance with another embodiment of the present invention, in which, the shade 5 is driven by a pair of wheels 6 and belt 8. This serves the same purpose as the previous construction so that shade 5 is kept at a desired position.

Figure 4:
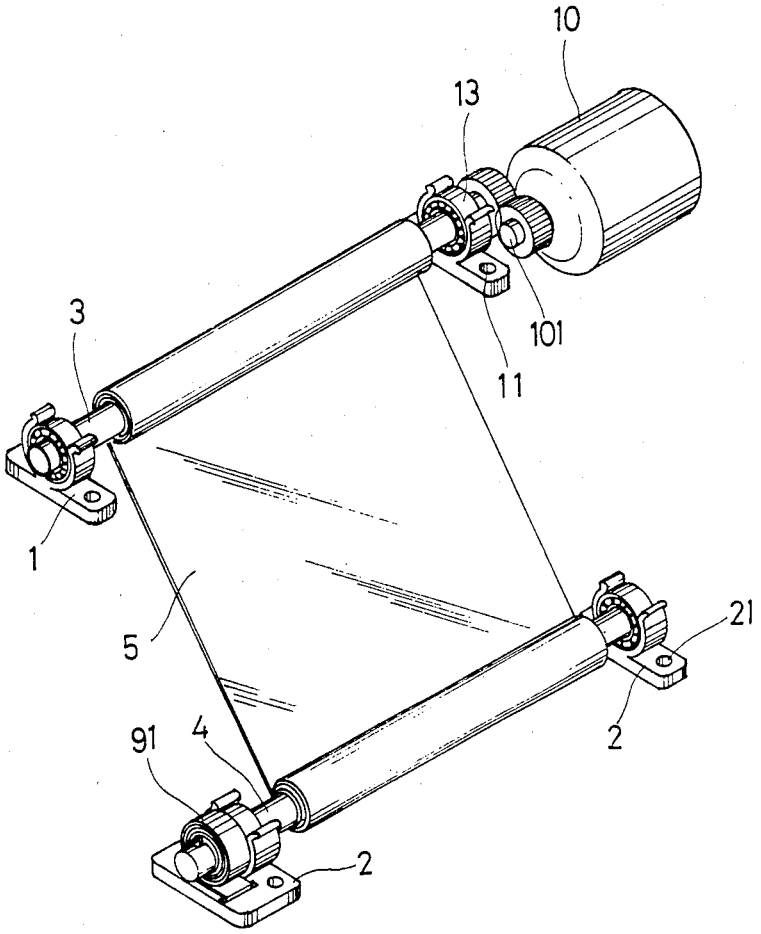
FIG. 4 is a view showing the assembly of the driving mechanism of another embodiment in accordance with the present invention.

The driving mechanism which comprises two wheels 6, 7; two belts 8, 9; and one motor 10 in order to drive shade 5 to move between roller 3 and roller 4 can be replaced with the following mechanism. This mechanism can consist of only two elements, a spring 91 and motor 10, as shown in FIG. 4 in which one end of the spring 91 is fixed to roller 4 and the other end is fixed next to the bracket. The motor drives shade 5 to move and wind toward roller 4 while the shade portion on roller 3 is unwound and provides a torsion effect on spring 91. When motor 10 runs counterclockwise, shade 5 moves and winds in an opposite direction by means of releasing force from spring 91. As a result, a desirable intensity of light is obtained by controlling the directions that the motor turns to adjust the position of shade 5 and holes 51.

Figure 5:
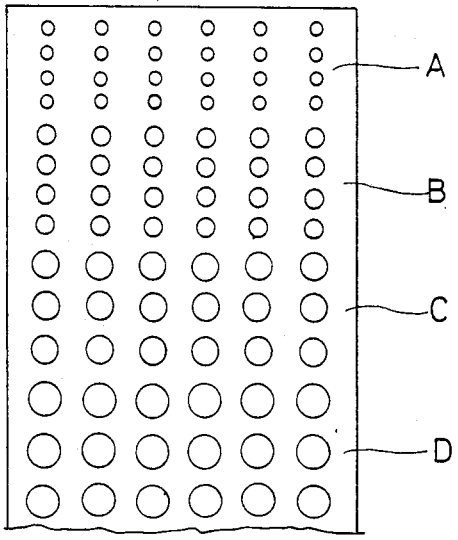
FIG. 5 is a plan view of the window shade in accordance with the present invention.

Referring now to FIG. 5, this is another plan view of the window shade in accordance with the present invention, in which the shade 5 is divided into several sections with holes made and designed thereon which are enlarged section by section. That is, holes on section B will be larger than those on section A, and holes on section C larger than holes on B, and so on to ensure a suitable brightness of light.

Figure 6:
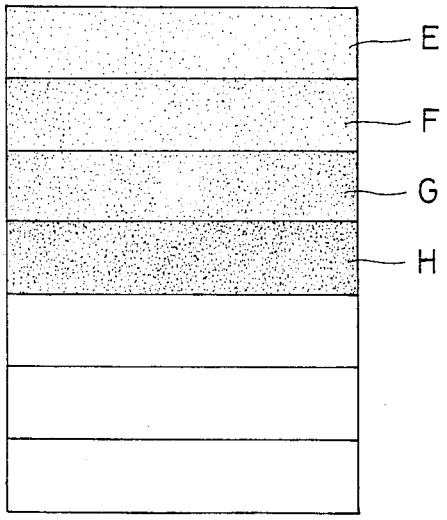
FIG. 6 is another plan view of the window shade in accordance with the present invention.

As shown on FIG. 6 which is another plan view of the window shade in accordance with the present invention, in which the shade is made of transparent plastic cloth or so-called glassine in colors shading from light to dark, that is, color on E section is lighter than that on F section, and F section is lighter than G section, and so on to provide a choice so that the desired amount of light may be obtained.

Accordingly, the present invention is a simple, but effective construction, in which it is possible to adjust the shade to a desirable position by rotating the motor in the proper direction to obtain a desirable brightness of light. This automatic operation by motor eliminates the danger caused by hand control and and also effectively removes any sight hindrance while driving.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. A window shade structure comprising a first set of brackets mounted at a top of a window frame, a second set of brackets mounted at a bottom of said window frame, a first roller positioned in said first set of brackets, a second roller positioned in said second set of brackets, a shade fixed to said first and second rollers and having a length layer than the distance between said first roller and said second roller, means for driving said shade to move between said rollers and thereby wind said shade, said means including a motor, said shade having a plurality of holes of various sizes along its length, and said means providing means to adjust said shade to a desirable position so that a suitable intensity of light passes through said shade.

2. The window shade structure as claimed in claim 1, in which a casing is provided to cover the shade wound on each of said first and second rollers to provide an improved appearance.

3. The window shade structure as claimed in claim 1, in which bearings are inserted between brackets and rollers, to provide smooth turning of said rollers.

4. The window shade structure as claimed in claim 1, in which said means includes more than one pair of wheels and more than one belt.

5. The window shade structure as claimed in claim 1, in which said means includes a torsion spring installed on one of said rollers and said motor on the other said roller, a desirable position of window shade being obtained by the operation of said motor and said torsion spring.

6. The window shade structure as claimed in claim 1, in which said shade is divided into several sections along its length and said holes increase in dimension section by section.

* * * * *